US006886471B2

(12) United States Patent
Rodnunsky

(10) Patent No.: US 6,886,471 B2
(45) Date of Patent: May 3, 2005

(54) TRAVELING HIGHLINE SYSTEM

(75) Inventor: James Lewis Rodnunsky, Granada Hills, CA (US)

(73) Assignee: Cablecam International Inc., Granada Hills, CA (US)

( * ) Notice: Subject to any disclaimer, the term of this patent is extended or adjusted under 35 U.S.C. 154(b) by 0 days.

(21) Appl. No.: 10/368,137

(22) Filed: Feb. 18, 2003

(65) Prior Publication Data

US 2003/0145759 A1 Aug. 7, 2003

(51) Int. Cl.[7] ..... B61B 11/00

(52) U.S. Cl. ..... 104/173.2; 104/178; 104/112; 104/116; 212/313; 212/98

(58) Field of Search ..... 104/114, 112, 104/115, 116, 122, 137, 173.1, 173.2, 197, 178, 87; 105/163.1; 212/312, 313, 321, 74, 98; 348/144, 157; 352/197; 396/12, 7

(56) References Cited

U.S. PATENT DOCUMENTS

| | | | | |
|---|---|---|---|---|
| 367,610 | A | | 8/1887 | Falnman |
| 482,648 | A | * | 9/1892 | Olson ..... 212/313 |
| 494,389 | A | | 3/1893 | Sherman |
| 572,491 | A | * | 12/1896 | Locher ..... 212/80 |
| 578,980 | A | | 3/1897 | Eddy |
| 894,348 | A | | 7/1908 | Seele |
| 969,356 | A | | 9/1910 | Fitzgerald |
| 1,002,897 | A | | 9/1911 | Brown |
| 1,301,967 | A | | 4/1919 | Parks |
| 1,634,950 | A | | 7/1927 | Lucian |
| 1,731,776 | A | | 10/1929 | Henry |
| 1,782,043 | A | | 11/1930 | Lawson |
| 1,948,934 | A | | 2/1934 | O'Rourke |
| 1,955,770 | A | | 4/1934 | Richards |
| 2,004,133 | A | | 6/1935 | Romano |
| 2,055,673 | A | * | 9/1936 | Smilie ..... 212/313 |
| 2,446,096 | A | | 7/1948 | Moore |
| 2,490,628 | A | | 9/1949 | Isserstedt |
| 2,523,267 | A | | 9/1950 | Aschenbrenner et al. |
| 2,899,882 | A | | 8/1959 | Wylle |
| 3,043,444 | A | | 7/1962 | Melton |
| 3,065,861 | A | | 11/1962 | Cruciani |
| 3,094,054 | A | | 8/1963 | Moors et al. |
| 3,107,791 | A | | 10/1963 | Michael |
| 3,333,713 | A | * | 8/1967 | Cruciani ..... 212/76 |
| 3,638,502 | A | | 2/1972 | Leavitt et al. |
| 4,017,168 | A | | 4/1977 | Brown |
| 4,227,279 | A | | 10/1980 | Tribolet |

(Continued)

FOREIGN PATENT DOCUMENTS

| | | |
|---|---|---|
| AT | 150740 | 9/1937 |
| FR | 992069 | 10/1951 |
| FR | 2318664 | 2/1977 |
| GB | 516185 | 12/1939 |

*Primary Examiner*—Mark T. Le
(74) *Attorney, Agent, or Firm*—Dalina Law Group P.C.

(57) ABSTRACT

A traveling highline aerial cable rail system for moving objects over large distances in three-dimensional space. A pair of track dollies mounted beneath substantially parallel and distantly separated support trusses allow the entire load bearing highline itself to traverse X-axis space. The highline defines the Y-axis of the system and supports a skate that moves along this axis. A platform suspended from the skate moves vertically in the Z-axis and can support extremely heavy loads depending on the gauge of the rope used in the system. A three motor pulley system with a multiplicity of sheaves allow independent movement of all three axes. The system can move objects weighing thousands of pounds stably at 60 miles per hour or more through three-dimensional space. The system can be modularly widened along the X-axis by adding truss sections, and the highline can be configured to up to 1000 feet or more, using rope that can support several tons or more. The Z-axis displacement can be multiplied via a pulley arrangement.

13 Claims, 7 Drawing Sheets

U.S. PATENT DOCUMENTS

| | | | | | |
|---|---|---|---|---|---|
| 4,331,975 | A | | 5/1982 | Krawza | |
| 4,370,932 | A | | 2/1983 | Etcheparre et al. | |
| 4,492,168 | A | | 1/1985 | Cellai | |
| 4,553,675 | A | * | 11/1985 | Kirk | 212/312 |
| 4,625,938 | A | | 12/1986 | Brown | |
| 4,710,819 | A | | 12/1987 | Brown | |
| 4,742,777 | A | | 5/1988 | Tarassoff | |
| 4,802,416 | A | | 2/1989 | Meindl | |
| 4,848,241 | A | | 7/1989 | Kunczynski | |
| 4,864,937 | A | | 9/1989 | Kunczynski | |
| 5,020,443 | A | | 6/1991 | Gauthier | |
| 5,088,610 | A | * | 2/1992 | Garnier | 212/196 |
| 5,113,768 | A | | 5/1992 | Brown | |
| 5,225,863 | A | * | 7/1993 | Weir-Jones | 396/56 |
| 5,440,476 | A | | 8/1995 | Lefkowitz et al. | |
| 5,445,282 | A | * | 8/1995 | Erikkila | 212/312 |
| 5,568,189 | A | * | 10/1996 | Kneller | 348/144 |
| 5,585,707 | A | | 12/1996 | Thompson et al. | |
| 6,145,679 | A | | 11/2000 | Walters | |
| 6,566,834 | B1 | | 5/2003 | Albus et al. | |

* cited by examiner

TRAVELING HIGHLINE SYSTEM

BACKGROUND OF THE INVENTION

1. Field of the Invention

This invention relates to a method and apparatus for moving objects within three-dimensional space. More specifically, the invention relates to a traveling highline aerial cable rail system.

2. Description of the Related Art

The controlled movement of heavy objects through large volumes of three-dimensional space has given rise to inventions that fail to satisfactorily achieve the full spectrum of speed, load bearing, volume serviced, extensibility, maintainability and platform stability. A "highline" system is a system based on an elevated cable or rope, along which objects are transported.

According to the invention disclosed in U.S. Pat. No. 5,020,443, a highline invention is described which can haul heavy loads, but does not provide quick movement in the X-axis, since large tractors supporting the ends of the highline must be physically relocated. The tension on the highline can vary dramatically depending on obstacles that lie within the path of the vehicles, which can cause the Z-axis of the payload to vary greatly during motion along the X-axis.

In U.S. Pat. No. 6,145,679, an invention is disclosed in which balloons keep the highline aloft, however, one end of the invention is rigid, which would inhibit moving a rescue container or piece of equipment, or log payload to a defined location outside of the pie-shaped space that the invention services. Also, high winds would plague the system as the high surface area of the balloons would render controlled movement inconceivable. Servicing a group of containers at the lower point of the highline requires movement of the containers since the highline is fixed at the lower end.

In U.S. Pat. No. 5,585,707, an invention is disclosed in which a robot or person can be readily moved within three-dimensional space. Although this invention does not use a highline, it is still able to traverse three-dimensional space. The payload is limited and the support structure is small scale. If the structure were to be scaled up, obstacles such as trees or buildings would inhibit the motion of the payload through a path between two points defined within the cube, since there are so many wires required to practice the invention. Also, the invention would not appear to allow the Z-axis to vary beneath the cube, and the size of the cube support structure to service a large volume of space would be extremely expensive to build on the scale required.

In U.S. Pat. No. 5,568,189, an invention is disclosed for moving cameras in three-dimensional space. The problems with the '189 invention are many when scale of the system is enlarged. FIG. 4 clearly shows how the two parallel highline cables sag inward, when the payload is in the middle of the X, Y space. Since the invention does not use strong rails to support the Y-axis rope, the weight bearing of the invention is dependent upon the strength of the building or structure in which it is mounted and the springs in its weight bearing X-axis connectors. The motors for the various axes are mounted up in the rigging, which would require multiple extremely long power cables to traverse the volume of space along with the payload if the invention were modified for outdoor use. The power cables would total over 3 times the length of the longest axis to drive the far X-axis motor, the Y-axis motor and the Z-axis motor. Mounting heavy motors high in the rigging presents a major safety issue given that suspension lines can break. The size of the motors limits the payload that can be carried, and further limits the speed at which the payload can be carried. The invention is also fixed in size, not allowing for modular addition of X travel, or increasing the Y or Z-axis travel without mounting the structure in a bigger studio or building a bigger hanger.

BRIEF SUMMARY OF THE INVENTION

The invention is a traveling highline aerial cable rail system. A highline system is a system based on an elevated cable or rope, along which objects are transported. Embodiments of the invention can move objects throughout three-dimensional space quickly, accurately and stably by laterally moving the entire highline, each end of which coupled with a horizontal highline vehicle, or "track dolly" for short. Each track dolly is coupled with and travels in the direction defined by an associated track. The track is coupled with an associated horizontal support structure, or "truss" for short, that may or may not be completely parallel with the track. The system comprises a plurality of tracks, the most distantly separated two of which are substantially parallel. Movement of the track dollies associated with a highline provides movement of the highline and its payload in a direction defining the X-axis direction. Movement of a vertical support vehicle, or "skate" for short, in the direction of the highline provides for movement in a direction defining the Y-axis direction. Vertically moving a platform suspended from the skate provides for movement in a direction defining the Z-axis. Many types of useful devices may then be attached to the platform including devices that require external power or devices that possess their own power and are operated via wireless signals.

An embodiment of the invention uses a pair of coupled drive pulleys each of which control rope to their corresponding track dollies in order to move both track dollies simultaneously in the same amount along the X-axis, keeping the highline substantially parallel to the Y-axis. In this embodiment, another drive pulley independently controls the rope coupled with the skate, and a drum winch independently controls rope coupled with the platform. The ropes in this embodiment pass through multiple sheaves before finally reaching their intended recipients. By using sheaves that loop Y-axis and Z-axis ropes through the track dollies to the skate, Y-axis and Z-axis movement remains independent of X-axis traversal. When moving only in the X-axis direction, the skate sheaves and sheaves suspending the platform hence freely rotate, while maintaining a constant platform position in Y and Z space. Creating a three axis movement configuration from ropes driven from a point distantly located from the payload is non-trivial, but provides advantages of allowing the motors to be large, power cables to be short and located near a large generator and control computer and maintenance to be readily performed in one location. The Z-axis may also contain a pulley arrangement that multiplies the Z-axis travel, so that the full volume of space serviced is $X*Y*N*Z$, where N is the multiplication factor of the Z-axis pulley configuration.

In one embodiment of the invention the term "horizontal support structure" means a truss, modular truss, beam, ledge, building or any other object that a track may be coupled with. The term modular in terms of horizontal support structure and track means that these elements may be extended by adding more of the respective elements to build larger structures.

In one embodiment of the invention the term "track" means any device which allows a track dolly to move along the direction defined by the track whether or not the track physically touches the track dolly as in the case of magnetic levitation. In addition, the truss and track elements may be modular to allow for expansion in the X-axis by adding more of these elements.

In one embodiment of the invention the term "vertical support vehicle" or "skate" means any device that can move along the highline, in one direction or the other via any means including sheaves, bearings, wheels, frictional non-rolling sliding skids, sled devices or any other device including devices that do not touch the highline such as magnetic levitation devices, allowing for movement in the direction of the highline and that can support the weight of the platform below.

In one embodiment of the invention the term "rope" is interchangeably used for rope, cable or any other linear connecting device that is strong and flexible.

In one embodiment of the invention the term "substantially parallel" in terms of truss alignment means any configuration where the invention still functions properly allowing controlled movement in the X, Y and Z axes.

In one embodiment of the invention the term "wireless" means any signal that is transmitted without direct electrical contact.

Embodiments of the invention can stably move objects weighing thousands of pounds by utilizing heavy gauge rope that can support several tons, yet is extremely lightweight and pliable. The limit of weight carried can be scaled to any size by scaling the rope, trusses, track dollies and various other parts utilized. Embodiments of the invention utilize track dollies that move in the direction defined by tracks coupled with the trusses to keep the system from sagging inward under heavy loads, providing for more accurate positioning of the Z-axis platform that is independent of the X-axis position of the track dollies.

The system is configured to move objects across any axis by using motors mounted beneath the rigging, on or near the ground, to drive the ropes. These motors connect to a generator that can be as large as the application requires in order to produce the requisite payload speed. The system may, for instance, move objects at speeds up to 60 miles an hour or more. The reader should note, however, that lesser or greater speeds are attainable by modifying the size of motors used to control the ropes. The sheaves themselves may contain high speed bearings and are may be configured to capture the rope in order to prevent derailing in order to add a degree of safety to the system. The drive pulleys comprise grooves that grip the rope in order to prevent slippage, however any means of driving rope may be substituted for grooved pulleys. In embodiments of the invention where the track dollies comprise wheels, the wheels of the track dollies can be made from material that supports large amounts of weight, yet still allows for smooth X-axis travel.

The system is scalable and can thus be resized in order to modify the volume covered. In one embodiment of the invention this is accomplished by adding modular truss sections on each opposing truss section and lengthening the highline and axis positioning ropes.

Embodiments of the invention eliminate the problems associated with high winds by minimizing the area of the skate.

U.S. Pat. No. 5,224,426 to the inventor of present apparatus, Rodnunsky, is hereby incorporated by reference.

DETAILED DESCRIPTION OF THE INVENTION

The invention is a traveling highline aerial cable rail system. Embodiments of the invention can move objects throughout three-dimensional space quickly, accurately and stably by moving the highline itself laterally along two substantially parallel truss members, providing movement in the X-axis direction, while moving a skate along the highline in the Y-axis direction, and vertically moving a platform suspended from the skate in the Z-axis. Many types of useful devices may then be attached to the platform. In addition, the truss and track sections may be modular to allow for expansion in the X-axis.

Figure 1:
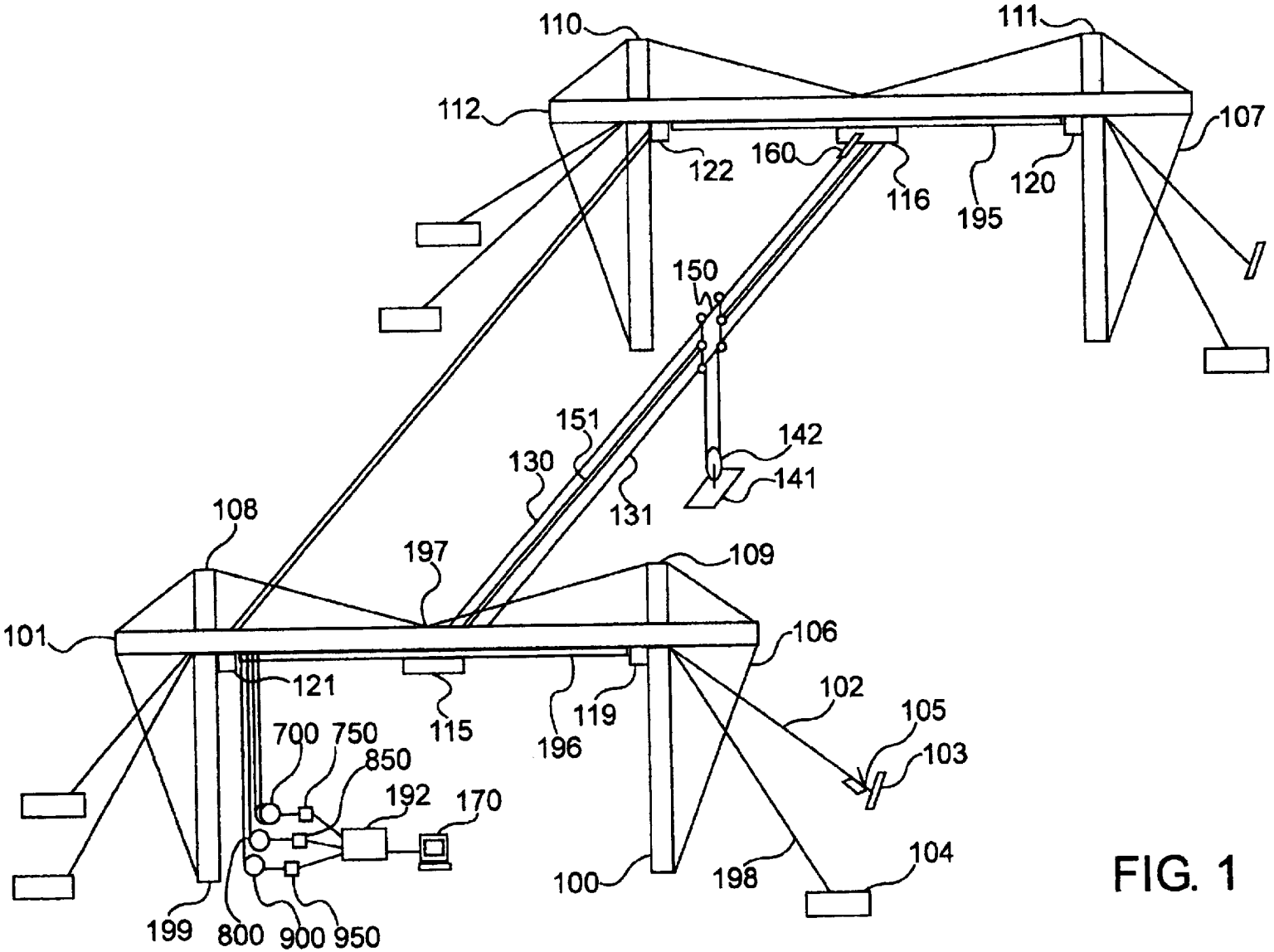
FIG. 1 is a perspective view of the overall system.

FIG. 1 shows a perspective view of an embodiment of the present invention. For the purpose of this discussion, the truss 101 forms the X-axis, the highline 130 forms the Y-axis of the system and the support structure 100 forms the Z-axis. In this configuration, vertical support structure 100 and 199 separates truss 101 from the terrain. The support structures are anchored to the terrain via rope 102 and stake 103 and rope 198 and heavy block 104. The reader will note that any fastening device that can hold the tension required can be used to secure the structures. The vertical support structures and trusses may be built from lightweight metal, and may be modular to enable quick disassembly and shipping in standard cargo containers. Hand winch 105 provides tensioning of rope 102. Hand winches can be used on the other fastening lines as well. Truss support rope 106 supports the middle of truss 101, by looping over top support structures 108, 109, connecting to truss 101 at truss midpoint 197. One skilled in the art will recognize that these particular vertical support structures are not required to practice the invention as large trees, buildings, the side of a canyon or hill or any other structure that would provide vertical clearance from the terrain below the trusses would enable the invention to be practiced. Truss section 112 is located distantly from truss 101 and is substantially parallel to truss 101. Alignment can be performed with a commonly available contractors leveling system.

In other embodiments of the invention, multiple highlines may be utilized by employing additional track dollies utilizing existing tracks or independent tracks per truss. Additional X, Y and Z ropes and associated sheaves are utilized in this embodiment in order to independently control each platform.

Generator 192 powers the system. Electronics drive units 750, 850 and 950 derive power from generator 192, and electrically control the rotation of the motors 700, 800 and 900 respectively. Computer 170 can run off an internal battery or be powered via generator 192. An embodiment of the invention can run fiber optics cables or power cables along highline 130 draping the cables between at least one skate that follows skate 150 along the highline.

Figure 2:
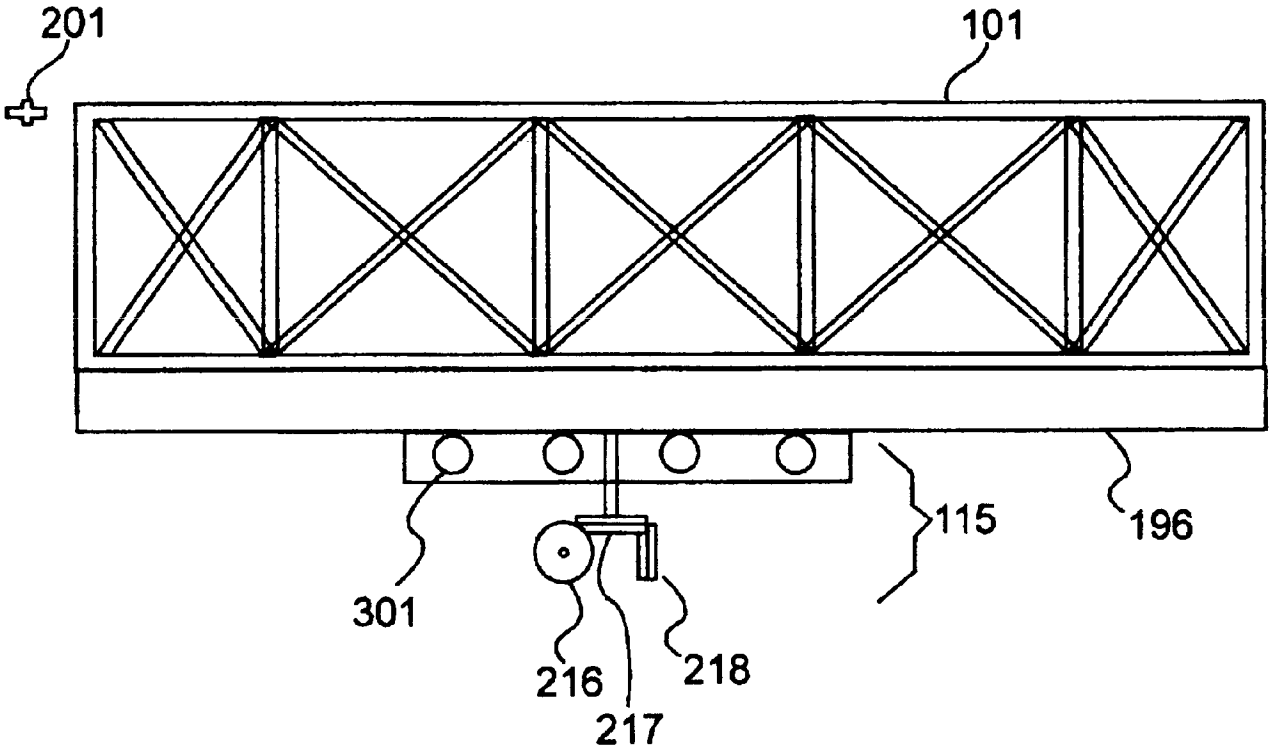
FIG. 2 is a front view of a single truss member, tracks and track dolly.
Figure 3:
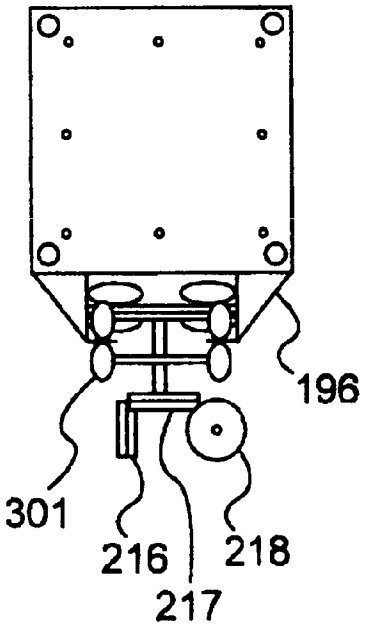
FIG. 3 is a side view of a single truss member, tracks and track dolly.

FIG. 2 shows track dolly 115 riding in track 196 attached beneath truss 101, the track dolly provides movement in the X-axis direction. By placing the modular sections end to end, any width of truss and track can be constructed. The truss sections and tracks that are connected via pins 201. The sections are then bolted together or connected together with any other fastening apparatus. An embodiment of the invention uses multiple sheaves 216, 217 and 218 in place of a single sheave in order to provide for a more secure change of direction for the rope that is less susceptible to derailing. Different embodiments of the invention can use multiple sheave arrangements virtually anywhere where a single sheave is used in order to change direction of a rope. Although sheaves that with groove shapes and rounded edges that minimize the lateral friction on ropes passing through the sheaves may be utilized in order to minimize the amount of wasted power in the system, different embodiments of the invention may use any type of sheave that works with the rope specified for the system. FIG. 3 shows a side view of FIG. 2.

FIG. 1 shows track dolly 116 riding in track 195 attached beneath truss 112, the track dolly provides movement in the X-axis direction on the other end of highline 130. The X-axis ropes are configured for automatic or manual control of tensioners 119, 120, 121 and 122 allowing the track dollies to smoothly and symmetrically traverse the tracks. If track dollies 115 and 116 are not kept equidistance from their respective ends, a jerky movement results. The reeving pattern for the X-axis ropes allows adjustment of X-axis track dolly 115 position relative to opposing track dolly 116.

Figure 4:
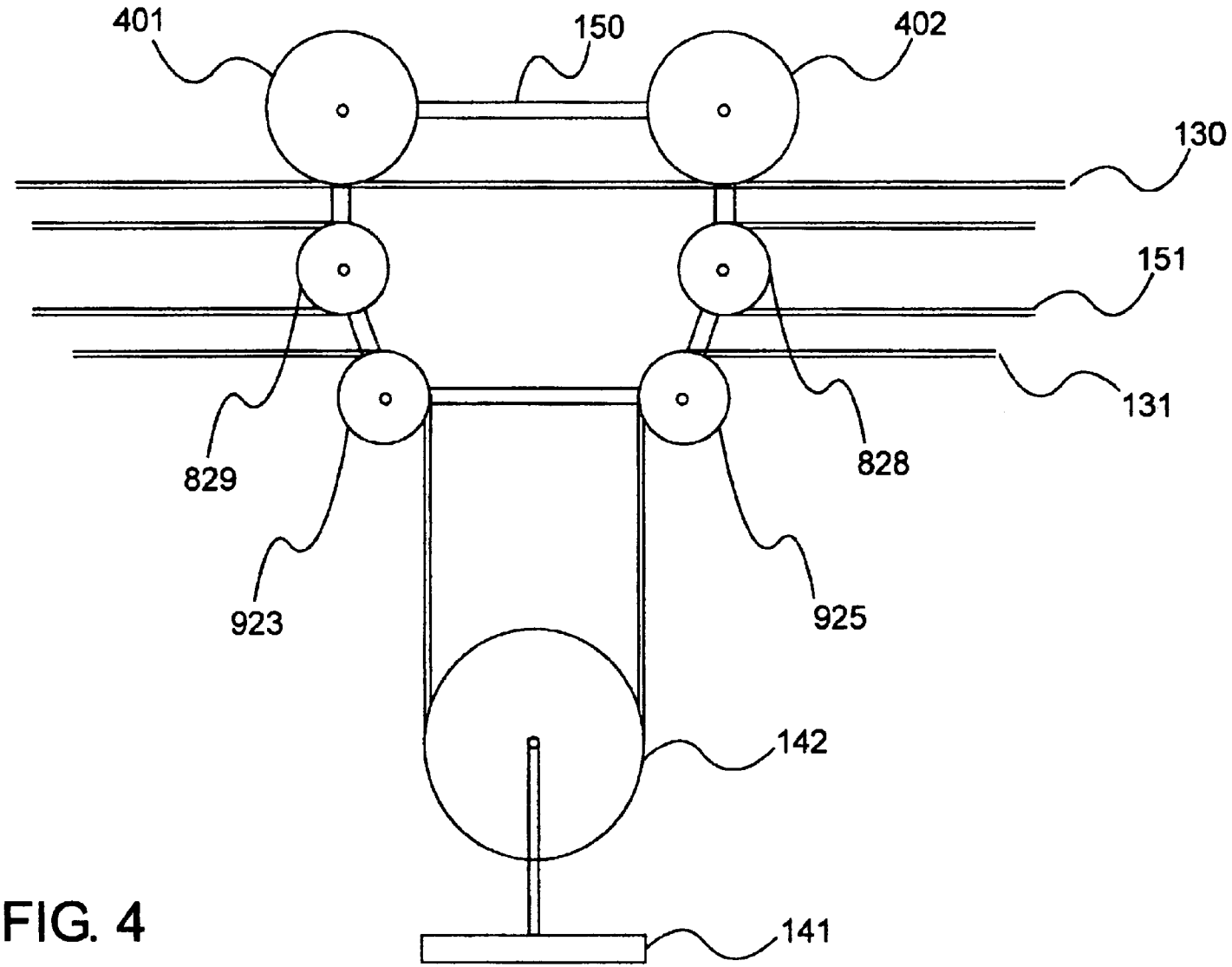
FIG. 4 is a side view of the skate and platform.

Highline 130 connects track dollies 115 and 116 riding under opposing trusses, and can be tensioned at approximately 20% of the rated strength of the rope for a margin of safety. For example, use of commercially available rope such as Spectron #2, synthetic 1.125 diameter rope allows for tensioning up to 10 tons. However, the reader should note that the invention is not limited to a specific type of rope or gauge. Platform 141 is suspended from skate 150 and comprises large sheave 142. Any desired payload is attached to the platform. A dynamometer 160 can be inserted in-line with the highline to provide tension readings to computer 170, via a wireless signal. The skate 150 is pulled along the Y-axis direction via Y-axis rope 151 and in FIG. 4, the skate rides the highline on sheaves 401 and 402.

Figure 5:
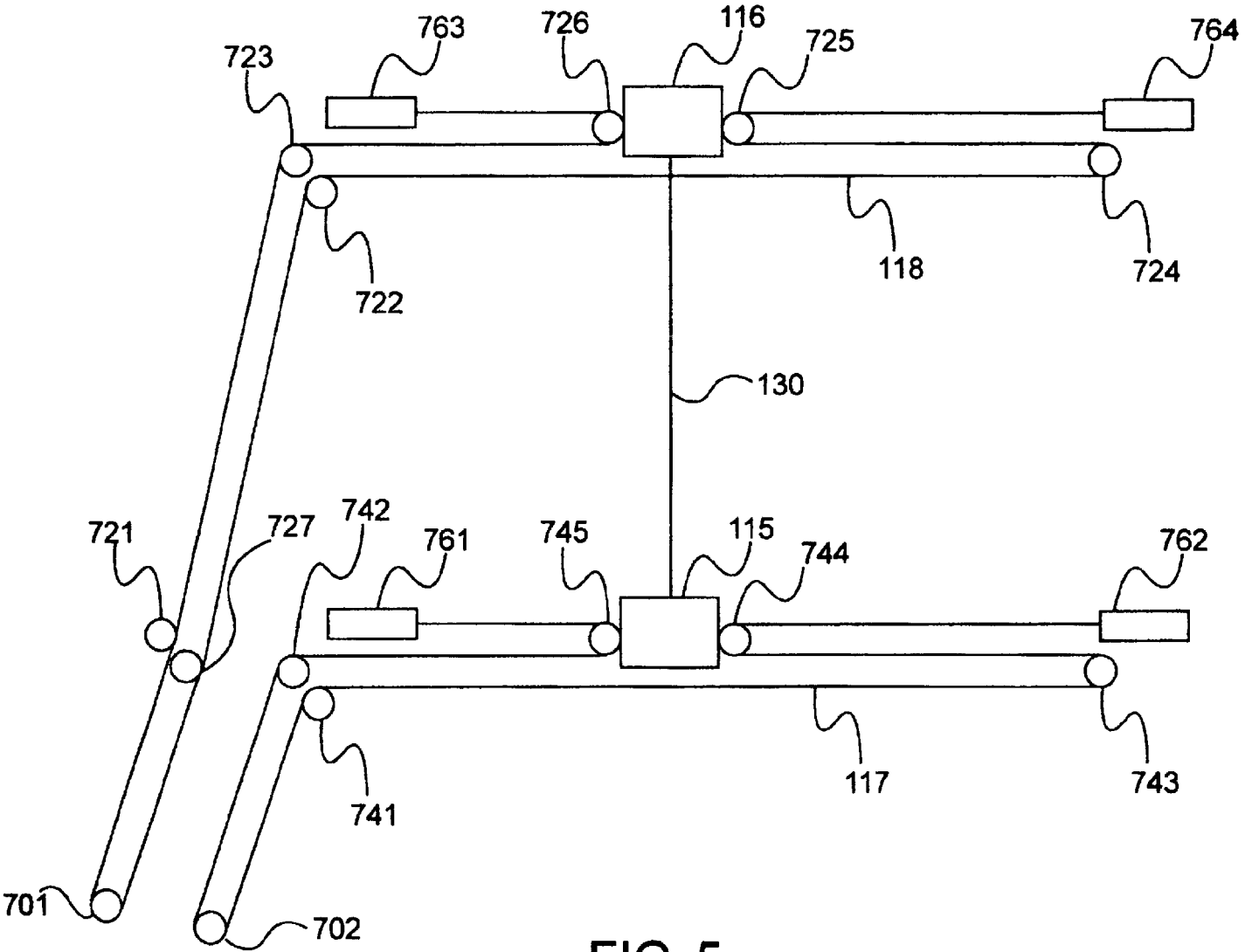
FIG. 5 is a view of the X-axis reeving.

FIG. 5 shows X-axis ropes 117, 118 which are driven by two gears 701, 702 mounted on a common shaft by X-axis motor 700. As motor 700 rotates in a given direction, rope 117 is pulled from one side of track dolly 115, which moves the track dolly in that direction. Rope 117 moving upward into sheave 742 moves into sheave 745 attached to track dolly 115, increasing the length of rope between sheave 745 and tensioner 761. As the rope moves in this direction, it flows downward from sheave 741, directly from sheave 743 on the opposing side of the truss 101, out of sheave 744, decreasing the distance from sheave 744 to tensioner 762. This motion of rope pulls track dolly 115 to the right. The opposite direction of movement of rope 117 pulls the track dolly to the left.

The movement of track dolly 116 on the opposing truss 112 occurs in the same manner although the X-axis rope 118 traverses the entire Y-axis length to and from truss 112. As the motor 700 rotates in a given direction, the rope 118 is pulled from one side of the track dolly 116, which moves the track dolly an equal amount as track dolly 115 is moving since the two ropes 117 and 118 are driven from a common shaft. Rope 118 moving upward into sheave 721 moves into sheave 723 and then sheave 726 which is attached to track dolly 116, increasing the distance to tensioner 763. As rope 118 moves in this direction, it flows downward from sheave 727, directly from sheave 722, from sheave 724, from sheave 725, thereby decreasing the distance from sheave 725 to tensioner 764. This motion of rope pulls the track dolly 116 to the right. The opposite direction of movement of the rope pulls the track dolly to the left.

Figure 6:
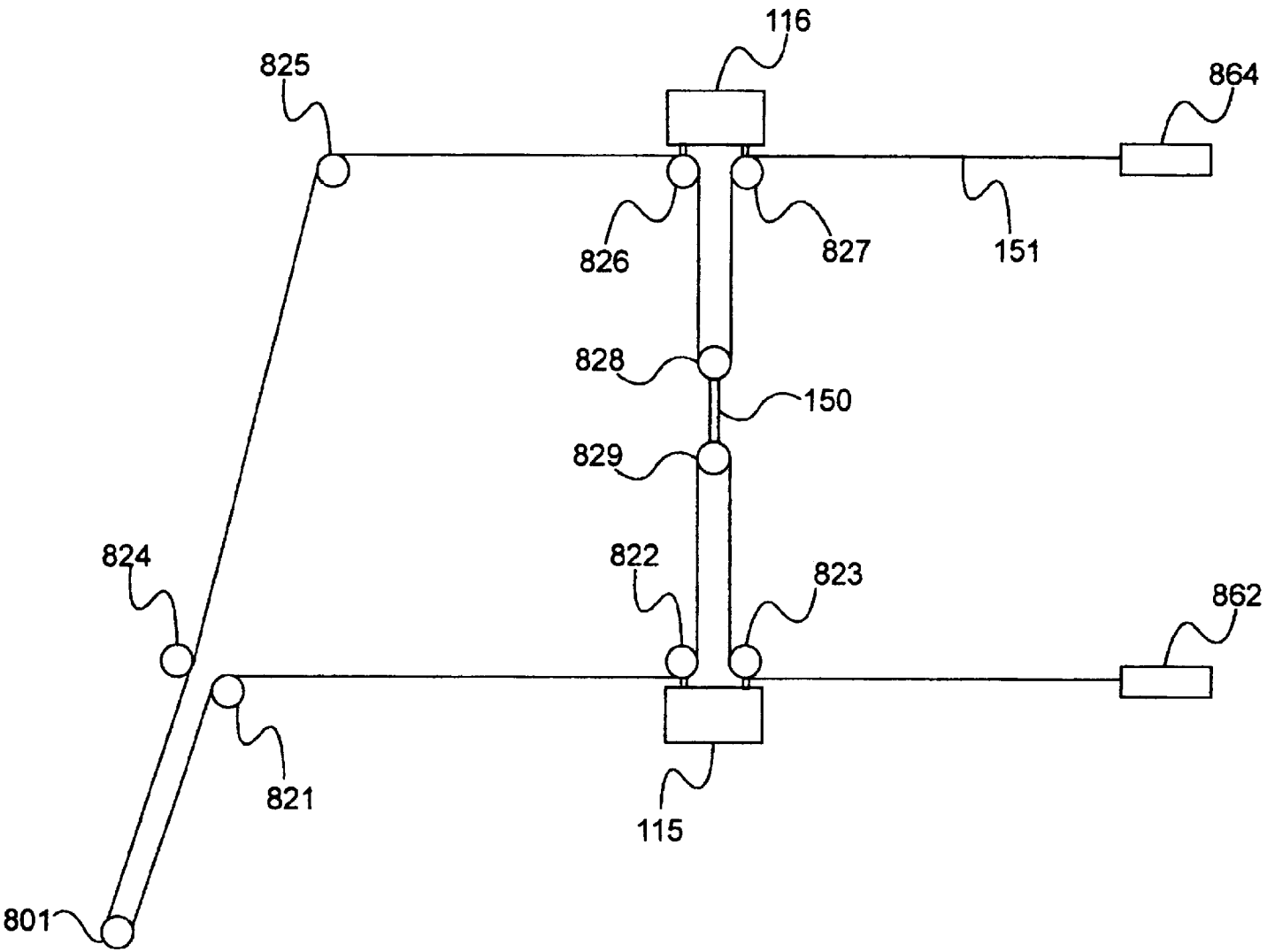
FIG. 6 is a view of the Y-axis reeving.

FIG. 6 shows the Y-axis rope 151 which is driven by drive gear 801 coupled to Y-axis motor 800. As motor 800 rotates in one direction, rope 151 is pulled from one side of skate 150, pulling the skate along in that direction. Rope 151 moving upward into sheave 824 moves into sheave 825 which moves into sheave 826 which flows into sheave 828 which is attached to the side of the skate, as it unwinds the rope out to sheave 827, effecting motion of the skate away from truss 112. Rope 151 flows downward from sheave 821 directly from sheave 822 from sheave 829 which is attached to the side of the skate, which pulls the skate closer to truss 101. Sheaves 826, 827, 828, 822, 823 and 829 allow skate 150 Y-axis position to remain constant when the track dollies 115 and 116 move from one X-axis position to another, by freely rotating, therefore, with drive gear 801 stopped, these six Y-axis sheaves will still rotate when track dollies 115 and 116 move in the X-axis direction even though the skate 150 remains at a constant Y-axis position.

Figure 7:
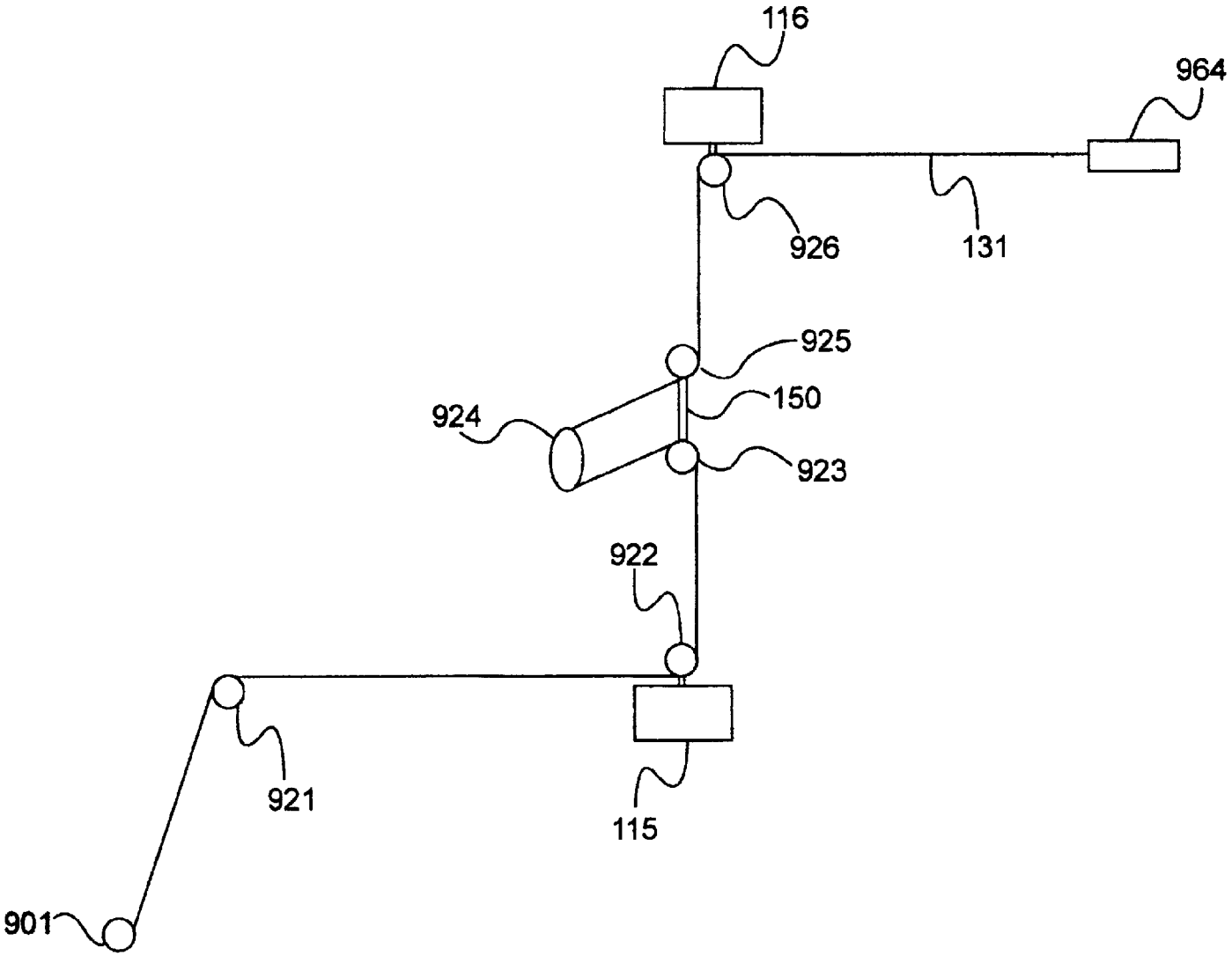
FIG. 7 is a view of the Z-axis reeving.

FIG. 7 shows the Z-axis rope 131 which is tied and wound onto a drum winch 901. By unwinding rope from the drum winch, rope 131 is moves up into sheave 921 into sheave 922 which is attached to track dolly 115, moves into sheave 923 which is attached to skate 150 which flows into large sheave 924, which is connected to the platform, which lengths the distance between sheave 924 and sheave 925, and effects a lowering of platform 141. The opposite motion of the rope effects a raising of the platform. Sheaves 926, 925, 924, 923 and 922 allow the platform 141 Z-axis position to remain constant when the track dollies 115 and 116 move from one X-axis position to another, by freely rotating as the same amount of rope flowing out of sheave 926 is flowing into sheave 922, therefore, with the drum winch stopped, these five Z-axis sheaves will still rotate when track dollies 115 and 116 move in the X-axis direction even though the platform 141 remains at a constant Z-axis position, in other words, at the same height.

The three axes of movement are completely independent of each other, so when the Z-axis position of the platform moves, the X-axis and Y-axis positions of the platform do not move, likewise, when the X-axis position moves, the Y-axis and Z-axis positions do not move and when the Y axis position moves, the X-axis and Z-axis positions do not move.

An embodiment of the invention contains a simple block and tackle fitted between the drum winch 901 and 921 in order to provide a Z-axis N-factor multiplier. This allows a multiplication factor to be calculated by determining the total amount of rope that each side of the block and tackle assembly contains and dividing the amount of rope on the sheave side by the amount of rope extendable on the drum winch side. For example, if there were two pulleys on the sheave side with corresponding mounted pulley and terminator on the sheave side, and one pulley on the drum winch side terminated at the height of the drum winch, then the total amount of rope that each side could let out would be 4*z lengths of rope on the sheave side and 2*z lengths of rope on the drum winch side, where z is the height of the support structure 199, therefore the multiplication factor would be 2. This would allow platform 141 to descend to two times the height of support 199. Increasing the number of sheaves looped through on one side or the other of the block alters the multiplication factor accordingly. In addition, if the rope attached to the drum winch broke, the furthest that the platform 141 would fall would be the amount of rope on the sheave side, in this case two times the height of the support structure. After altering the reeving, computer 170 can recalibrate to take the rope length changes into account immediately.

Another embodiment of the invention involves using three sheaves each time a long reach rope changes direction. A vertical sheave supports rope that has traveled a long distance, this is attached to a horizontal sheave for direction change, which then feeds another vertical sheave in the next direction of travel. FIG. 2 and FIG. 3 show sheaves 216, 217 and 218 assembled in this arrangement. In addition, all sheaves in this embodiment are built using high speed bearings and are built to capture the rope to prevent derailing. This is an important safety aspect of this embodiment.

FIG. 3 shows the wheels 301 on the track dollies which are built to maintain fluid X-axis carriage movement while under Y-axis tensions of up to 10,000 pounds or more on the highline. In an embodiment of the invention, the wheels are constructed from high density DELRIN® and the bearings are preloaded, although any material capable of handling high loads and smooth travel along the track may be substituted for DELRIN®.

Figure 8:
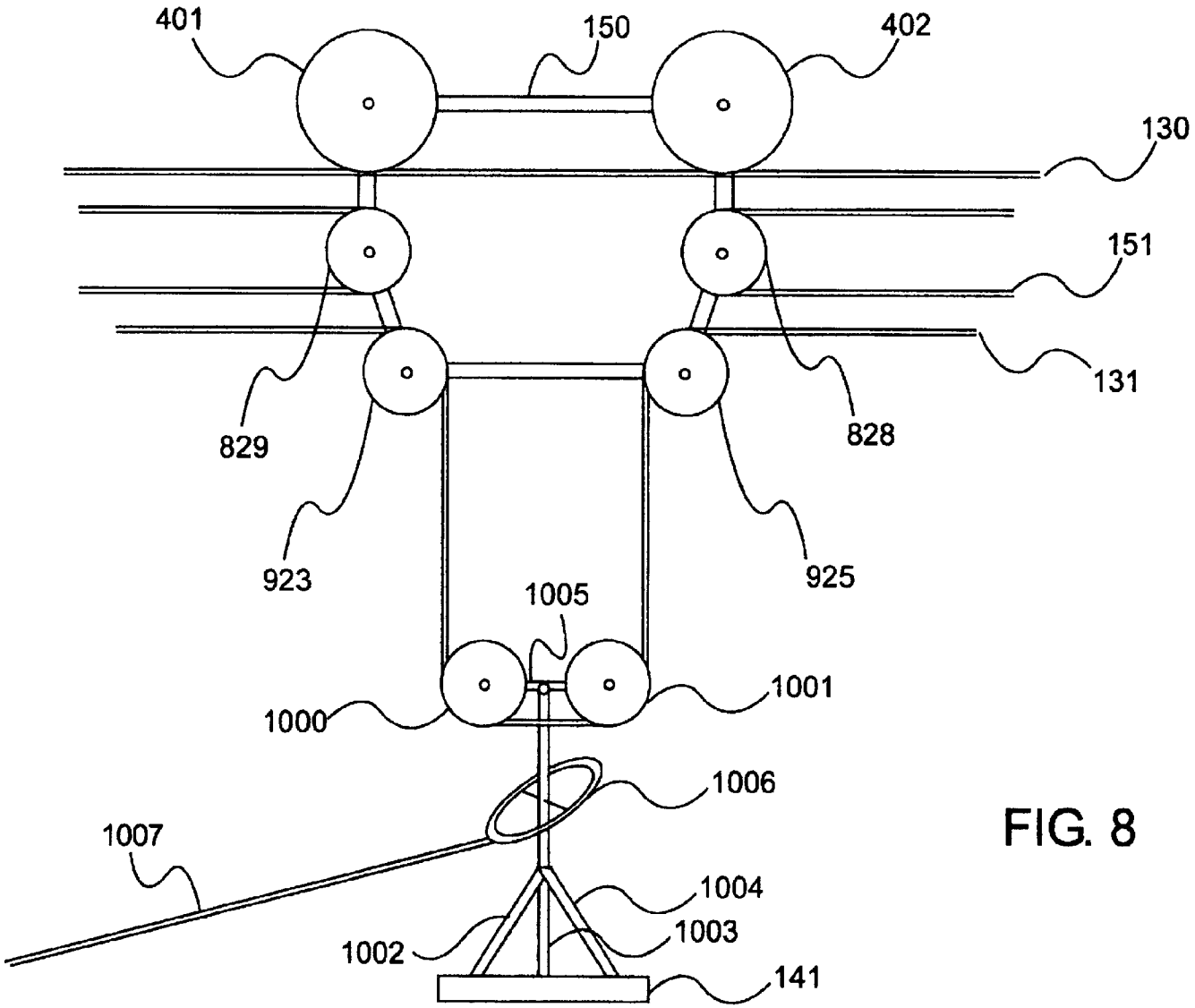
FIG. 8 is a view of the stabilized platform rigged from a lower skate and gimbal.

An embodiment allowing for even higher stability platform control is shown in FIG. 8 and comprises a lower skate 1005 that can be narrower, as shown, or wider than skate 150 in the Y-axis direction of the invention. Z-axis rope passes through sheave 1000 and 1001, and with wider distances between these two sheaves the platform is less susceptible to twisting about the Z-axis. The platform 141 is suspended from at least one dampener, and in this embodiment is suspended from three dampeners 1002, 1003 and 1004. The dampeners can be active or passive in stabilization. Platform gimbal 1006 rotates about its circumference and is attached to "tag line" 1007 in order to provide immediate control of the platform oscillations when stopping or starting motion of the platform. The use of a tag line allows for any perturbation of the system to be eliminated including, but not limited to, gusts of wind, swaying of the highline, explosions, earthquakes, or any other external force that would inject unwanted movement into the platform.

Tag line 1007 may be vectored to any location within three dimensional space and may be operated by hand, winch or any other mechanism that winds and unwinds rope. Tag line 1007 may be "passive" meaning that the length of the tag line does not change as the platform moves, or "active" meaning that the tag line is set in motion while moving the platform. Another embodiment allows the tagline to attach to skate 150 directly without using gimbal 1006, which is useful in high wind situations. Another embodiment employing an active tag line runs the tag line off of motor 800 using a subset of the grooves of drive gear 801 so that they two lines travel out the same amount when moving the platform in the Y-axis direction, this configuration keeps the Z-axis height from varying as much as the passive tag line embodiment. Another embodiment of the invention employs a counterweight on the tag line at the end of a loop that hangs over truss 112 in order to compensate for the weight of platform 141. Depending on the obstacles that need to be traversed in these higher stability requirement scenarios, the point at which the tag line is pulled from may dynamically change as well in addition to changing the amount of rope dispensed. In each of these "tag line assemblies", the platform or skate is held or moved in or away from the point at which tag line 1007 is vectored to.

Platform 141 can have many different apparatus attached to it to perform a variety of functions including but not limited to stabilization devices, gimbals, camera equipment, mining loaders, ship-to-ship loaders, logging devices, ski lift seats, gondolas, body sensing flight simulator suits for allowing a person to simulate flight like a bird including wireless transmitter back to computer 170 to transmit flapping gestures, reduced gravity simulator suits, lifting harnesses, munitions depot bomb retrievers, digital video equipment for security checks in railroad yards or nuclear facilities, robotic agricultural harvest pickers for quickly picking and storing grapes or other produce or any other device that benefits from repeatable placement and motion in three dimensional space. In another embodiment, platform 141 comprises a witness camera mounted pointing down from the platform, providing a picture from the viewpoint of the platform.

What is claimed is:

1. A system for three dimensional movement of an object comprising:

a first track and a second track, said second track arranged substantially parallel to said first track and wherein said first track and said second track are rigid;

a first horizontal support structure and a second horizontal support structure, said first track coupled with said first horizontal support structure and said second track coupled with said second horizontal support structure;

a first track dolly configured to travel along said first track;

a second track dolly configured to travel along said second track;

a highline coupled with said first track dolly and with said second track dolly;

a skate supported by said highline;

a platform suspended from said skate;

a Y movement rope configured to move said skate wherein said Y movement rope is coupled with said skate via said first track dolly and said second track dolly; and, a Y movement motor coupled with said Y movement rope;

a first X movement rope configured to move said first track dolly and a second X movement rope configured to move said second track dolly wherein a Y position of said skate is independent of an X-axis movement of said skate when said first X movement rope and said second X movement rope move and said Y movement rope is not moved between opposing sides of said skate;

an X movement motor coupled with said first X movement rope and said second X movement rope wherein said first track dolly and said second track dolly move an equal distance when said X movement motor is rotated in a first direction;

a Z movement rope configured to vertically move said platform wherein said Z movement rope is coupled with said platform via said skate and via said first track dolly and said second track dolly;

a Z movement motor coupled with said Z movement rope; and, wherein said X movement motor, said Y movement motor and said Z movement motor are computer controlled and ground mounted distally from said first track, said second track, said first track dolly, said second track dolly, said highline, said skate and said platform.

2. The system of claim 1 further comprising an electrical generator and plurality of drive units.

3. The system of claim 1 wherein said platform is electrically coupled to said generator.

4. The system of claim 1 further comprising a dampener mounted on said platform wherein said dampener is selected from the group consisting of an active dampener and a passive dampener.

5. The system of claim 1 further comprising a lower skate interposed between said skate and said platform.

6. The system of claim 5 wherein said lower skate is coupled to a beam which is coupled to at least one universal joint that is coupled to said platform.

7. The system of claim 6 wherein said platform further comprises a tag line assembly.

8. A method of three dimensional movement comprising:

placing a first track substantially parallel to a second track wherein said first track and said second track are rigid;

coupling a first track with a first horizontal support structure and coupling a second track with said second horizontal support structure;

mounting a first track dolly near said first track and mounting a second track dolly near said second track;

coupling a highline to said first track dolly and to said second track dolly;

mounting a skate on said highline;

suspending a platform from said skate;

coupling a Y movement rope with said skate;

coupling a Y movement motor with said Y movement rope;

coupling a first X movement rope with said first track dolly and coupling a second X movement rope with said second track dolly;

moving said skate in an X-axis direction by moving said first X movement rope and said second X movement rope while maintaining a Y-axis position of said skate without moving said Y movement rope between opposing sides of said skate;

coupling an X movement motor to move said first X movement rope and said second X movement rope wherein said first track dolly and said second track dolly move an equal distance when said X movement motor is rotated in a first direction;

coupling a Z movement rope to said platform via said skate and via said first track dolly and said second track dolly;

coupling a Z movement motor to said Z movement rope; and, mounting said X movement motor, said Y movement motor and said Z movement motor at ground level distally from said first track, said second track, said first track dolly, said second track dolly, said highline, said skate and said platform wherein said X movement motor, said Y movement motor and said Z movement motor are computer controlled.

9. The method according to claim 8 further comprising:.

moving said first track dolly and said second track dolly;

moving said skate; and, moving said platform.

10. The method according to claim 8 further comprising:

controlling platform movement with a computer system and tag line assembly.

11. A system for three dimensional movement comprising:

means for placing a first track substantially parallel to a second track wherein said first track and said second track are rigid;

means for coupling a first track with a first horizontal support structure and means for coupling a second track with said second horizontal support structure;

means for mounting a first track dolly near said first track and means for mounting a second track dolly near said second track;

means for coupling a highline to said first track dolly and to said second track dolly;

means for mounting a skate on said highline;

means for suspending a platform from said skate;

means for coupling a Y movement rope with said skate;

means for coupling a Y movement motor with said Y movement rope;

means for coupling a first X movement rope with said first track dolly and coupling a second X movement rope with said second track dolly;

means for moving said skate in an X-axis direction by moving said first X movement rope and said second X movement rope while maintaining a Y-axis position of said skate without moving said Y movement rope between opposing sides of said skate;

means for coupling an X movement motor to move said first X movement rope and said second X movement rope wherein said first track dolly and said second track dolly move an equal distance when said X movement motor is rotated in a first direction;

means for coupling a Z movement rope to said platform via said skate and via said first track dolly and said second track dolly;

means for coupling Z movement motor to said Z movement rope; and, means for mounting said X movement motor, said Y movement motor and said Z movement motor at ground level distally from said first track, said second track, said first track dolly, said second track dolly, said highline, said skate and said platform wherein said X movement motor, said Y movement motor and said Z movement motor are computer controlled.

12. The system according to claim 11 further comprising:

means for moving said first track dolly and said second track dolly;

means for moving said skate; and, means for moving said platform.

13. The system according to claim 11 further comprising:

means for controlling platform movement with a computer system and tag line assembly.

* * * * *